United States Patent [19]

Allen et al.

[11] 4,289,308

[45] Sep. 15, 1981

[54] PORTABLE THERAPY ENCLOSURE

[76] Inventors: Anna M. Allen; Donna I. Pudvan, both of 115 McTigue, Toledo, Ohio 43615

[21] Appl. No.: 190

[22] Filed: Jan. 2, 1979

[51] Int. Cl.[3] ..... A63B 23/04

[52] U.S. Cl. ..... 272/70; 217/16

[58] Field of Search ..... 272/70, 70.3, 70.4, 272/9, 13, 21, 25; 128/25 R; 220/6, 7; 217/16; 135/67; 248/174; 297/5, 6

[56] References Cited

U.S. PATENT DOCUMENTS

| | | | |
|---|---|---|---|
| 450,194 | 4/1891 | Saunders | 217/16 |
| 609,612 | 8/1898 | Deveau | 220/6 |
| 909,615 | 1/1909 | La Bauve | 220/6 X |
| 952,444 | 3/1910 | Goldenetz | 220/6 |
| 1,297,473 | 3/1919 | Johnson et al. | 272/25 |
| 1,338,608 | 4/1920 | Bench | 220/7 |
| 1,905,137 | 4/1933 | Blomberg | 220/6 |
| 2,560,089 | 7/1951 | Cottingham | 220/7 |
| 2,633,006 | 3/1953 | Taylor | 220/6 X |
| 3,612,516 | 10/1971 | Wilson | 272/9 |

*Primary Examiner*—Richard C. Pinkham
*Assistant Examiner*—Arnold W. Kramer
*Attorney, Agent, or Firm*—Wilson, Fraser, Barker & Clemens

[57] ABSTRACT

A portable, dismountable therapy enclosure assists invalids and patients with walking disabilities in regaining use of their legs. The therapy enclosure consists of a platform upon which a multi-sided enclosure having sufficient interior space to receive a standing patient is removably positioned and secured. The multi-sided enclosure includes at least one hinged side panel through which the patient may enter and exit the enclosure. The upper portion of the enclosure defines a generally U-shaped horizontal surface which functions as an armrest. Standing within the confines of the enclosure, the legs of a patient are maintained in substantially vertical weight-bearing relationship to the patients body and walking exercises may be safely performed.

5 Claims, 7 Drawing Figures

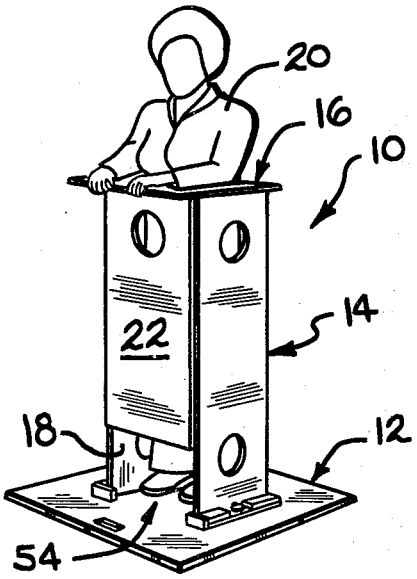
FIG. 1
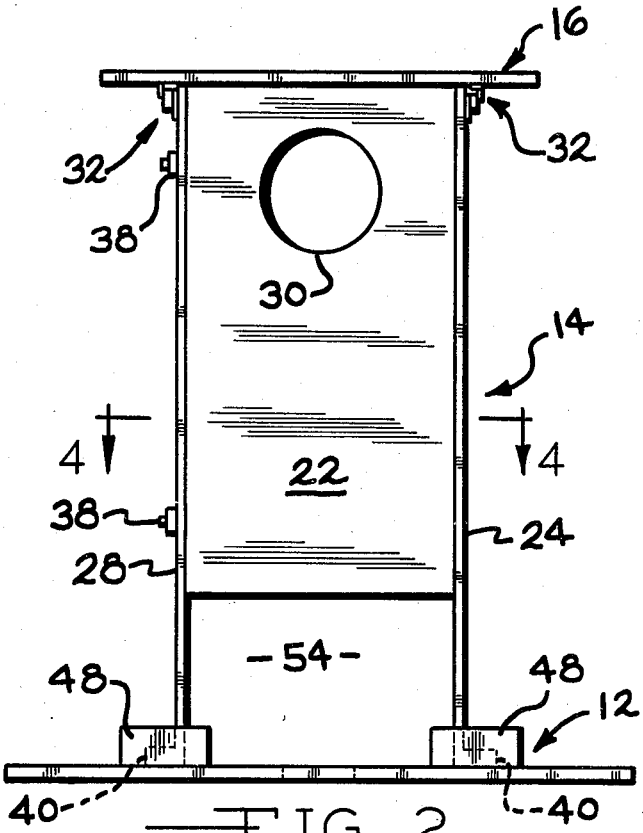
FIG. 2
FIG. 3
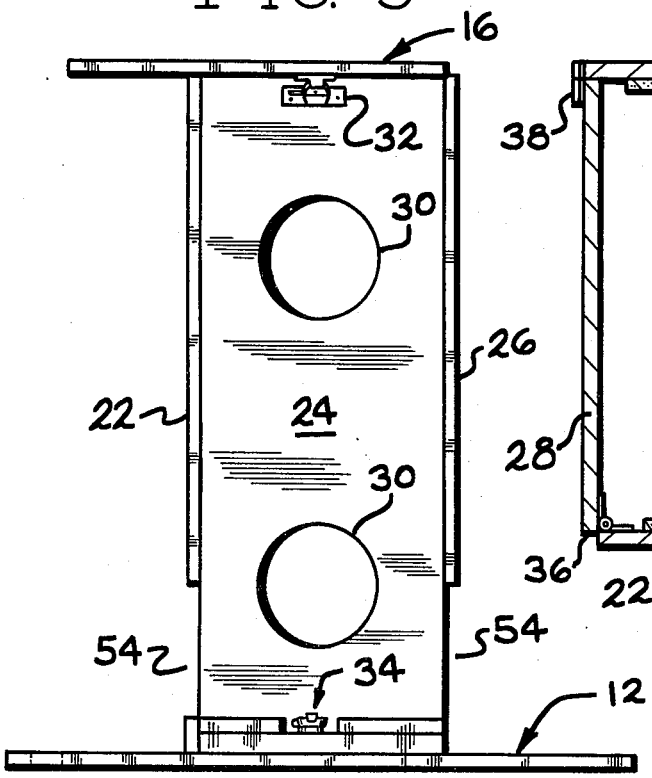
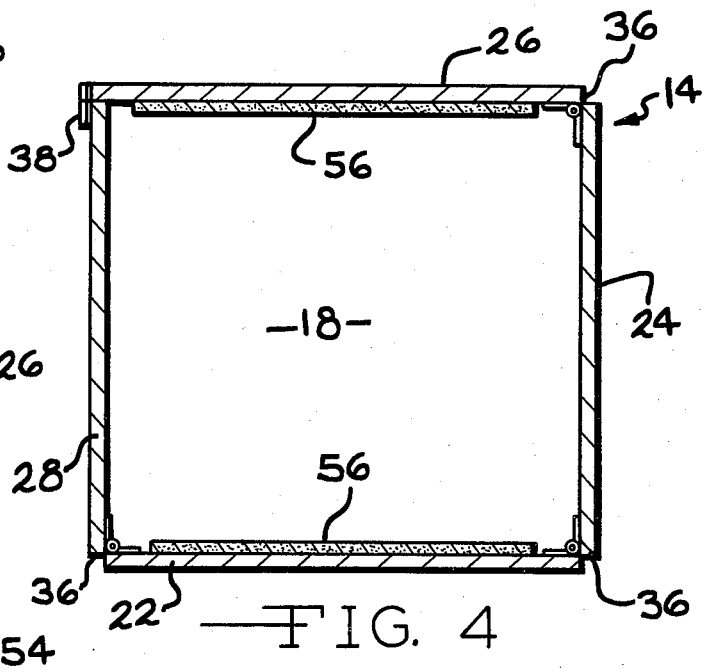
FIG. 4

PORTABLE THERAPY ENCLOSURE

BACKGROUND OF THE INVENTION

The invention relates generally to therapy devices and specifically to an exercise enclosure which supports and maintains the legs of a patient in a substantially vertical orientation which allows the patient to exercise and regain the ability to walk.

A common physical therapy problem is that of assisting a patient in regaining the facility of selflocomotion. An elderly person who has suffered a stroke, a person recovering from major surgery or an individual injured in an accident may find that walking is physically or physiologically impossible. Muscle strength, which has deteriorated, must be regained and coordination and motor control, which may be temporarily impaired, must be relearned before walking is once again possible.

Numerous devices have been designed to assist the recuperating patient in regaining the ability to walk. Several take the form of a metal frame walker such as is illustrated in U.S. Pat. Nos. 3,690,652; 3,993,349; or 2,862,544. Such walkers are generally helpful as movable support for a patient and are of assistance to those patients who are presently capable of maintaining proper leg extension and orientation.

A problem of severely handicapped or injured patients is their inability to maintain their legs in generally straight and vertical, weight-bearing relationship to their bodies. Walking therapy with the devices noted above is relatively futile inasmuch as they do not provide forward and rearward support to the legs of the patient and the patient's legs may fail to support him—due either to a lack of strength or a lack of control. If the patient is unable to stand, it is obvious that leg strengthening and walking exercises will be difficult or impossible. One current solution to this problem is to support the patient about the waist or upper torso by therapy equipment which removes a major portion of the weight from the patient's legs and slows the recuperative process.

SUMMARY OF THE INVENTION

The instant invention comprehends a vertical, walled enclosure for a patient which maintains the patient's legs in a substantially vertical, weight-bearing orientation. The enclosure may include three, four or more sides and a securable, hinged panel which may comprise one or more sides which may be opened to allow convenient ingress and egress by the patient. The sides of the enclosure may be interconnected by hinges or other flexible or dismountable means to permit the folding and/or disassembly of the sidewalls for simplified handling and storage. The enclosure's sidewalls mount and lock to a platform base which serves to maintain them in an upright orientation notwithstanding lateral and oblique forces exerted against the enclosure walls. The therapy enclosure preferably also includes a U-shaped upper platform which is removably attached to the sidewalls and which functions as a support surface for the forearms and elbows of a patient.

A patient placed within the enclosure will be standing upright with his feet substantially directly underneath him and therefore with his legs positioned and generally constrained to remain in weight-bearing relationship to his upper body. The patient may then safely move and exercise his legs without danger of falling due to momentary imbalance or the buckling of a leg. Furthermore, the patient is able to exercise for relatively extended periods of time, stopping and resting as desired while requiring assistance only for entering and exiting the therapy enclosure.

It is thus the object of the instant invention to provide a therapy enclosure for assisting patients in the recovery of walking skills.

It is a further object of the instant invention to provide a therapy enclosure which assists patients who are unable to stand and support their own weight to regain walking balance.

It is a still further object of the instant invention to provide a walking and exercise therapy enclosure which is easily portable and quickly assemblable and disassemblable.

Further objects and uses for the instant invention will become apparent by reference to the following specification and drawings.

BRIEF DESCRIPTION OF THE DRAWINGS

FIG. 1 is a perspective view of the therapy enclosure of the instant invention illustrating its use by a patient;

FIG. 2 is a front elevational view of a therapy enclosure according to the instant invention;

FIG. 3 is a right side elevational view of the therapy enclosure according to the instant invention;

FIG. 4 is a full sectional plan view of the therapy enclosure of the instant invention taken along line 4—4 of FIG. 2;

DESCRIPTION OF THE PREFERRED EMBODIMENT

Figure 5:
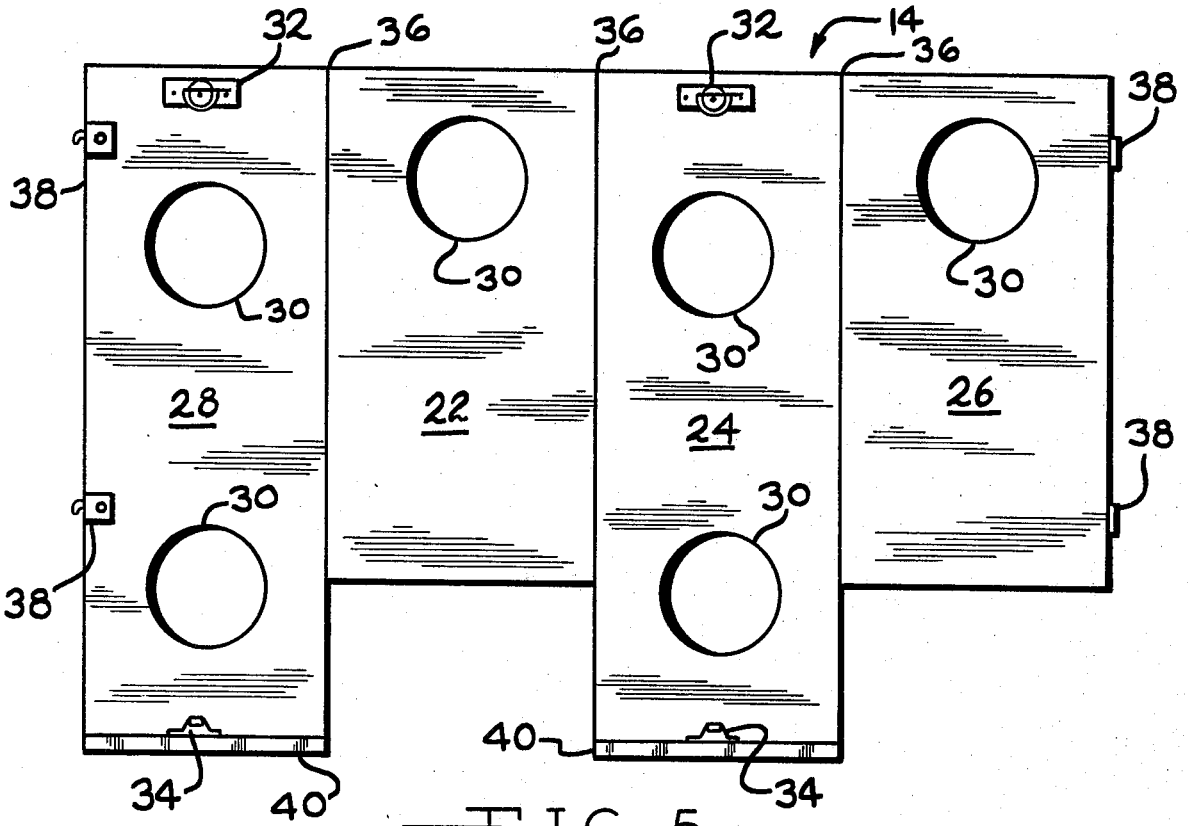
FIG. 5 is an elevational view of the four hinged sidewalls of the therapy enclosure according to the instant invention illustrated in adjacent, planar relationship.

Referring to FIG. 1, a therapy enclosure according to the instant invention is generally designated by the reference numeral 10. The therapy enclosure 10 comprises a horizontally disposed mounting base or platform 12, a generally vertically disposed enclosure assembly 14, removably secured to the platform 12 and a substantially horizontally disposed arm rest assembly 16 removably secured to the upper portion of the enclosure assembly 14. The platform 12, the enclosure assembly 14 and the arm rest assembly 16 define a generally vertically extending volume 18 within which a standing patient 20 may be comfortably contained. The overall height of the therapy enclosure 10 measured from the platform 12 to the arm rest assembly 16 will generally be in the range from three to four and one-half feet (0.9 meters to 1.35 meters) for an adult patient 20. A therapy enclosure 10 intended for use with children would, of course, be correspondingly smaller.

Referring now to FIGS. 2 and 3, the aspects of front and side elevations of the therapy enclosure 10 may be seen. The enclosure assembly 14 comprises a front panel 22, a right side panel 24, a rear panel 26 and a left side panel 28. The panels may be fabricated of any relatively rigid, lightweight material such as wood, plywood, fiberglass reinforced plastic, acrylonitrile-butadiene-styrene plastic or other similar material. The panels may include decorative cutouts 30 located preferably on the side panels 24 and 28 and on the upper portion of the front and rear panels 22 and 26, respectively. The cutouts 30 are preferably not located in the lower portion of the front and rear panels 22 and 26, respectively, inasmuch as cutouts so located may interfere with the function of the enclosure 10. The primary function of the decorative cutouts 30 is to lessen the amount of material in the side panels and thereby minimize the weight of the therapy enclosure 10. The number and location of the decorative cutouts 30 are thus selected accordingly.

At the top of both the right side panel 24 and the left side panel 28 are disposed a pair of upper latches 32 and at the bottom of both the right side panel 24 and the left side panel 28 are disposed a pair of lower latches 34. The pairs of latches 32 and 34 may be one of a number of commercially available manually engageable and releasable mechanisms which position and lock together two separable components. The pairs and latches 32 and 34 illustrated in the accompanying drawings are like those intended for use with residential windows. Various other latch assemblies will be apparent to those skilled in the appropriate art. The function and operation of the pairs of latches 32 and 34 will be described in more detail subsequently. At this juncture, however, it should be noted that a component of each of the pairs of latches 32 and 34 is mounted upon and selectively interconnects either the armrest assembly 16 or the platform 12 to the enclosure assembly 14.

With reference now to FIGS. 4 and 5, the structure of the enclosure assembly 14 will be described. As noted previously, the enclosure assembly 14 comprises four generally vertical sidewall panels 22, 24, 26 and 28 which define a space within which a person may stand. At three of the four corners defined by the intersecting panels 22, 24, 26 and 28 are disposed hinges 36. The hinges 36 are preferably of the type known as piano hinges and extend along substantially the full length of the wall intersections. The hinges 36, of course, may alternatively comprise a plurality of short, mechanical hinges or may, in fact, define single-piece plastic or fabric hinges where total weight of the therapy enclosure 10 is a significant design constraint. Interconnecting the adjacent edges of the rear panel 26 and the left side panel 28 is a pair of selectively securable latches 38. When latched, the pair of latches 38 maintain the rear panel 26 closed against the left side panel 28 and perpendicular to the side panels 24 and 28. When unlatched, the latches 38 permit the opening and outward pivoting of the rear panel 26 on the hinge 36 disposed between this panel and the right side panel 24. Disposed along the bottom lower margin of the right side panel 24 and left side panel 28 is an outwardly extending generally rectangular lip 40 upon which a component of each of the pair of lower latches 34 is secured.

Figure 6:
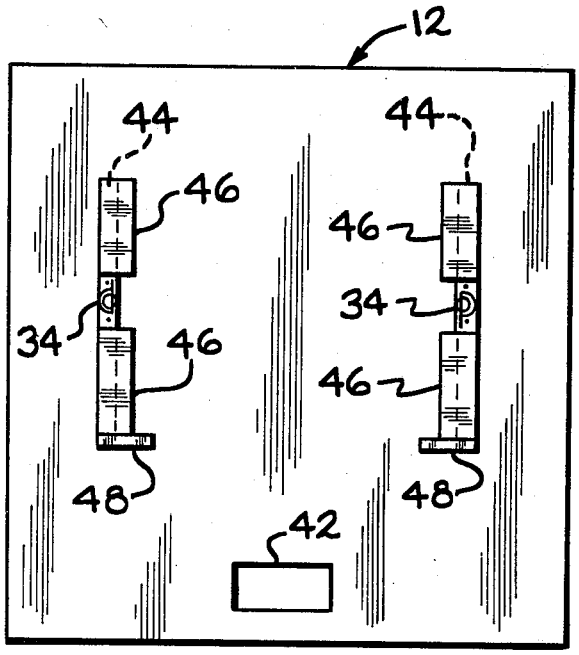
FIG. 6 is a top plan view of the platform base of the therapy enclosure according to the instant invention.

Referring now to FIG. 6, the platform 12 is seen to define a handle opening 42. The handle opening 42 is generally rectangular and is disposed adjacent one side and centered between intersecting sides. The handle opening thus provides a balanced location for grasping and carrying the platform 12. Secured to the surface of the platform 12 are a pair of symmetrically disposed mounting brackets 44. The brackets 44 are generally L-shaped in cross section and include overhanging lip portions 46. The mounting brackets 44 each further includes a stop 48 which extends inwardly of each mounting bracket 44 somewhat beyond the inner edges of the overhanging lip portion 46. A component of each of the pair of lower latches 34 is also secured to the mounting bracket 44.

Figure 7:
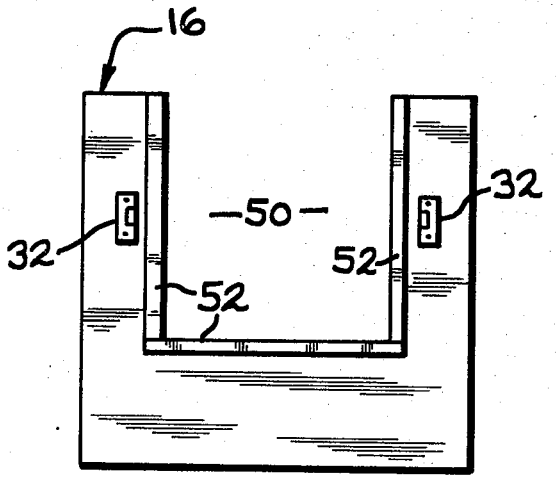
FIG. 7 is a bottom plan view of the armrest section of a therapy enclosure according to the instant invention.

FIG. 7 illustrates the underside of the armrest assembly 16. The armrest assembly 16 defines an opening 50 which is somewhat smaller than the inner dimensions of the rectangle defined by the enclosure assembly 14. About the three sides of the opening 50 and attached to the lower surface of the armrest assembly 16 is a depending ridge or rim 52. The outer rectangular dimensions of the rim 52 approximately coincide with the inner rectangular dimensions of the enclosure assembly 14 and thus the rim 52 provides centering for the armrest assembly 16 within the upper end of the enclosure assembly 14 when positioned thereon. Also disposed upon the lower surface of the armrest assembly 16 is a component of each of the pair of upper latches 32.

The assembly and utilization of the therapy enclosure 10 is straightforward. The platform 12 is placed on a substantially flat and level surface with the mounting bracket 44 up. The hinged enclosure assembly 14 is then positioned upon the platform 12 and the lips 40 on the right and left side panels 24 and 28, respectively, are aligned with and positioned under the overhanging portions 46 of the mounting brackets 44 and against the stops 48. The components of the lower pair of latches 34 are then activated and the enclosure assembly 14 is thus secured to the platform 12.

Finally, the armrest assembly 16 is positioned on the top of the enclosure assembly 14 with the open side of the opening 50 positioned toward the rear, i.e., the rear panel 26 of the enclosure assembly 14. The rim 52 is then slid into engagement with the inner walls of the enclosure assembly 14 and the components of the pair of upper latches 32 are engaged. The therapy enclosure 10 is thus assembled, as is illustrated in FIG. 1, preparatory to receiving a patient 20.

For use as a therapy and exercise device, the therapy enclosure 10 is assembled as just explained and the patient 20 stands within the vertical volume defined by the four sidewalls of the enclosure assembly 14. The rear panel 26 is then closed against the left side panel 28 and the latches 38 are secured. Positioned within the vertical volume 18, the lower extremities and particularly the knees of the patient 20 are restrained from unlimited forward and rearward movement by the front and rear panels 22 and 26, respectively. Such restraint prevents the knees of the patient 20 from buckling and maintains the patient's legs in substantial weight-bearing vertical alignment with the upper body. Thus, the patient 20 is able to simulate and achieve walking motion and exercise and strengthen the lower portions of the body while being precluded from falling.

It should be noted that the front panel 22 and the rear panel 26 do not extend fully between the platform 12 and the armrest assembly 16 but rather define an opening 54 between each panel and the platform 12. The openings 54 permit the feet of the patient 20 to extend beyond the confines of the enclosure assembly 14. It should also be noted that the interior walls at the enclosure assembly 14, especially the lower portion of the front panel 22 and the rear panel 26 adjacent the openings 54, may preferably be covered by a resilient pad 56. The pad 56 cushions the inner walls of the enclosure assembly 14 and minimizes any patient unpleasantness resulting from striking the walls of the enclosure assembly 14.

At the end of the therapy session, the latches 38 may be opened, the back panel 26 swung out and the patient 20 assisted from the enclosure 10.

Disassembly and transportation of the therapy enclosure 10 are also straightforward. The upper latches 32 are released and the armrest assembly 16 removed. Next, the sidewall latches 38 are inspected to confirm that they are released. The lower latches 34 are released and the walls of the enclosure assembly 14 may be folded together by virtue of the hinges 36 at their intersections and the entire enclosure assembly 14 may be removed from the platform 12. The enclosure assembly 14 folds flat. All three components of the therapy enclosure 10 are thus flat and may be easily carried and stored.

The foregoing disclosure is the best mode devised by the inventors for practicing this invention. It is apparent, however, that devices incorporating modifications and variations to the instant invention will be obvious to one skilled in the art of therapy devices. Inasmuch as the foregoing disclosure is intended to enable one skilled in the pertinent art to practice the instant invention, it should be construed to include such aforementioned obvious variations and be limited only by the spirit and scope of the following claims.

What we claim is:

1. A demountable therapy enclosure for assisting the reestablishment of walking skills of a person comprising, in combination, four generally vertically disposed walls, said walls including front and back opposed walls and two opposed side walls, having lower marginal edges, said walls defining a rectangular volume open at the upper end, said front and back walls spaced apart at a distance which maintains the legs of a person disposed in said volume in substantially vertical orientation, said front wall having a lower marginal edge disposed above said lower marginal edges of said side walls, hinge means for pivotally interconnecting said four walls along three spaced apart hinge axes, at least one latch means for selectively securing two of said walls to one another, a generally planar base disposed beneath said walls, means for selectively engaging said said walls to said planar base, said just recited means including a pair of outward projections each adjacent a respective one of said lower marginal edges of said side walls and a pair of cooperating overhanging lips disposed on said planar base.

2. The therapy enclosure of claim 1, further including a separable generally planar armrest, said armrest extending outwardly beyond at least one of said four walls and latch means for selectively engaging said armrest to the end of said side walls opposite said planar base in a generally horizontal orientation.

3. The therapy enclosure of claim 1, wherein said planar base includes at least one grippable means for facilitating the lifting and carrying of said base.

4. The therapy enclosure of claim 3, wherein said grippable means defines at least one opening adjacent the perimeter of said base.

5. An enclosure for assisting the exercise of the legs of a standing person comprising, in combination, a generally vertically extending hollow structure having an open upper end and defining a volume within which a person may stand, said structure having a pair of opposed generally vertical side panels having upper and lower marginal edges, a generally vertical front panel having an upper and a lower marginal edge, a pair of hinge means for pivotally securing said front panel to said side panels along parallel spaced apart axes, a generally vertical back panel having upper and lower marginal edges which facilitates the ingress and egress of such person, said lower marginal edges of said front and said back panels disposed substantially above said lower marginal edges of said side panels, hinge means for securing said back panel to one of said side panels, fastener means for selectively securing said back panel to the other of said side panels, a separable generally horizontal planar armrest having a width greater than the thickness of said side panels and disposed adjacent the upper marginal edges of said front and said side panels and means for selectively securing said armrest to said structure, a generally planar base disposed beneath said vertically extending structure, and means for selectively securing said vertically extending structure to said planar base, said selectively securing means including projections adjacent said lower marginal edges of said side panels and a pair of cooperating overhanging lips disposed on said planar base and latch means for securing said side panels to said planar base, whereby said panels maintain the legs of such person in substantially vertical weight bearing relationship to such person's upper body and facilitate walking exercises.

* * * * *